US009038727B2

(12) United States Patent
Bisset

(10) Patent No.: US 9,038,727 B2
(45) Date of Patent: May 26, 2015

(54) BLOWOUT PREVENTOR ACTUATION TOOL

(71) Applicant: Specialist ROV Tooling Services Ltd., Insch (GB)

(72) Inventor: Michael Alexander Bisset, Insch (GB)

(73) Assignee: SPECIALIST ROV TOOLING SERVICES LTD., Insch (GB)

( * ) Notice: Subject to any disclaimer, the term of this patent is extended or adjusted under 35 U.S.C. 154(b) by 245 days.

(21) Appl. No.: 13/669,946

(22) Filed: Nov. 6, 2012

(65) Prior Publication Data

US 2013/0112420 A1 May 9, 2013

Related U.S. Application Data

(60) Provisional application No. 61/557,556, filed on Nov. 9, 2011.

(51) Int. Cl.
*E21B 7/12* (2006.01)
*E21B 33/035* (2006.01)
*E21B 33/064* (2006.01)

(52) U.S. Cl.
CPC ..... *E21B 33/035* (2013.01); *E21B 33/0355* (2013.01); *E21B 33/064* (2013.01)

(58) Field of Classification Search
CPC ..... E21B 33/0355; E21B 33/064
USPC ..... 166/344, 363, 368; 405/190, 191
See application file for complete search history.

(56) References Cited

U.S. PATENT DOCUMENTS 3,405,387 A * 10/1968 Koomey et al. ..... 367/133
6,257,268 B1 * 7/2001 Hope et al. ..... 137/112
6,315,264 B1 * 11/2001 Baker ..... 251/14
6,484,806 B2 * 11/2002 Childers et al. ..... 166/351
6,702,025 B2 * 3/2004 Meaders ..... 166/335
7,108,069 B2 * 9/2006 Killie et al. ..... 166/336
7,503,391 B2 * 3/2009 McCanna et al. ..... 166/343
7,757,772 B2 * 7/2010 Donohue et al. ..... 166/344
7,934,376 B2 * 5/2011 Biester ..... 60/405
8,323,003 B2 * 12/2012 Judge et al. ..... 417/404
8,376,051 B2 * 2/2013 McGrath et al. ..... 166/368
8,397,742 B2 * 3/2013 Thrash et al. ..... 137/112
8,596,608 B2 * 12/2013 Grimseth et al. ..... 251/69
8,684,092 B2 * 4/2014 McGrath et al. ..... 166/368
8,746,345 B2 * 6/2014 Kotrla et al. ..... 166/344
8,770,950 B2 * 7/2014 Biester ..... 417/415

(Continued)

FOREIGN PATENT DOCUMENTS

WO WO2008/074995 * 6/2008
WO 2012/120307 A2 9/2012

OTHER PUBLICATIONS

Australian Office Action dated Oct. 9, 2014 for Application No. 2011250707.

*Primary Examiner* — Matthew Buck
*Assistant Examiner* — Aaron Lembo
(74) *Attorney, Agent, or Firm* — Patterson & Sheridan, LLP

(57) ABSTRACT

A tool for actuating a blow out preventer includes one or more connections for receiving hydraulic power from a remotely operated vehicle ("ROV"), a first pump for increasing pressure of an operating fluid for the blowout preventer ("BOP"), a second pump for increasing flow rate of the operating fluid, and a conductor for transporting the operating fluid to the BOP. The tool rapidly increases the pressure and flow rate of the fluid flowing to the BOP, and the BOP may be rapidly closed.

20 Claims, 9 Drawing Sheets

(56) References Cited

U.S. PATENT DOCUMENTS

| | | | | |
|---|---|---|---|---|
| 2007/0034379 | A1* | 2/2007 | Fenton et al. | 166/368 |
| 2008/0264646 | A1* | 10/2008 | Sten-Halvorsen et al. | 166/360 |
| 2010/0107622 | A1* | 5/2010 | Hohensee | 60/327 |
| 2010/0200241 | A1* | 8/2010 | Ward | 166/341 |
| 2011/0062063 | A1* | 3/2011 | Takahashi et al. | 210/143 |
| 2011/0266003 | A1* | 11/2011 | Singh et al. | 166/368 |
| 2012/0055679 | A1* | 3/2012 | Van Winkle | 166/363 |
| 2013/0333894 | A1* | 12/2013 | Geiger et al. | 166/336 |

* cited by examiner

BLOWOUT PREVENTOR ACTUATION TOOL

CROSS-REFERENCE TO RELATED APPLICATIONS

This application claims benefit to U.S. Provisional Application No. 61/557,556 filed on Nov. 9, 2011, which is herein incorporated by reference in its entirety.

BACKGROUND OF THE INVENTION

1. Field of the Invention

Embodiments of the invention generally relate to a tool used in a subsea environment to help prevent the release of hydrocarbons into a body of water. More particularly, the invention relates to a tool that is connected to a remotely operated underwater vehicle ("ROV"), which provides a high flow rate of fluid at a high pressure to a blowout preventer ("BOP") to manually actuate the BOP.

2. Description of the Related Art

A blowout preventer ("BOP") is a large piece of specialized oilfield equipment that is used to seal, control and monitor oil and gas wells. In a subsea environment, the BOP is attached to the top of the wellhead at the bottom of the ocean. The BOP then connects to an offshore rig through a drilling riser. Drill strings are lowered inside the drilling riser and through the BOP and rotated by equipment on the offshore rig to turn a drill bit and drill an oil and/or gas well.

As an oil and gas well is being drilled, the well can receive what is called a formation kick, which is a burst of high pressure that comes from the reservoir. These kicks can cause a variety of catastrophic events, such as drill pipe and casing being blown out of the wellbore, and, in severe cases, hydrocarbons being released into the ocean. The BOP is designed to prevent these catastrophic blow outs from occurring, or at the very least, to minimize their effects when they do occur.

Typically, when a kick occurs, the BOP is closed so that fluids do not flow out of the wellbore. More specifically, rams or shears in the BOP are closed which effectively close and seal the drilling riser, drill strings and associated piping that runs through the BOP. The BOP rams or shears are closed remotely, either by workers actuating the BOP from an offshore rig or by an automated actuation system.

When the BOP cannot be actuated remotely, there is a need for an apparatus, system and method of manually actuating a BOP at a rapid speed in the event the BOP cannot be remotely actuated.

SUMMARY OF THE INVENTION

The invention relates to a tool, method and system for actuating a blowout preventer ("BOP") in a subsea environment. In one embodiment, a tool for actuating a BOP includes one or more connections for receiving hydraulic power from a remotely operated vehicle ("ROV"), a first pump for increasing pressure of an operating fluid for the BOP, a second pump for increasing flow rate of the operating fluid, and a conductor for transporting the operating fluid to the BOP.

In one embodiment, a method of actuating a BOP includes hydraulically connecting the tool to the ROV, pumping a fluid through the tool, increasing pressure and flow rate of the fluid, connecting the tool to a BOP, and conducting fluid from the tool to the BOP until the BOP is fully actuated.

In one embodiment, a system of actuating a BOP includes an ROV, a fluid source, and a tool having one or more pumps, wherein the tool uses hydraulic power from the ROV to operate the one or more pumps, and wherein the tool increases pressure and flow rate of the fluid source and conducts the fluid source to the BOP until the BOP is fully actuated.

BRIEF DESCRIPTION OF THE DRAWINGS

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIGS. 2 and 3 are schematics of the tool shown in FIG. 1, wherein FIG. 2 illustrates the tool when the pumps use seawater, and wherein FIG. 3 illustrates the tool when the pumps use a fluid housed in one or more reservoirs to actuate a BOP.

DETAILED DESCRIPTION

In one embodiment, a tool enables a blowout preventer ("BOP") to be rapidly closed such as when the BOP cannot be closed by a remote means. The tool may be mounted to a remotely operated underwater vehicle ("ROV"), and the ROV provides hydraulic power to the tool. The tool is further connected to the BOP, such as by use of a hot stab connection, and is configured to push fluid to the BOP in order to actuate the BOP. The tool includes a high pressure pump and one or more high flow pumps. The tool first runs fluid through one or more high flow pumps until the fluid reaches a predetermined (elevated) pressure, and then switches the fluid flow to a high pressure pump. Because the tool is able to rapidly increase the pressure and flow rate of the fluid flowing to the BOP, the BOP may be closed at a rapid speed. In one embodiment, the tool of the present invention can fully actuate most BOPs in under 60 seconds, thereby sealing the wellbore and protecting the wellhead equipment and environment from further damage.

Figure 1:
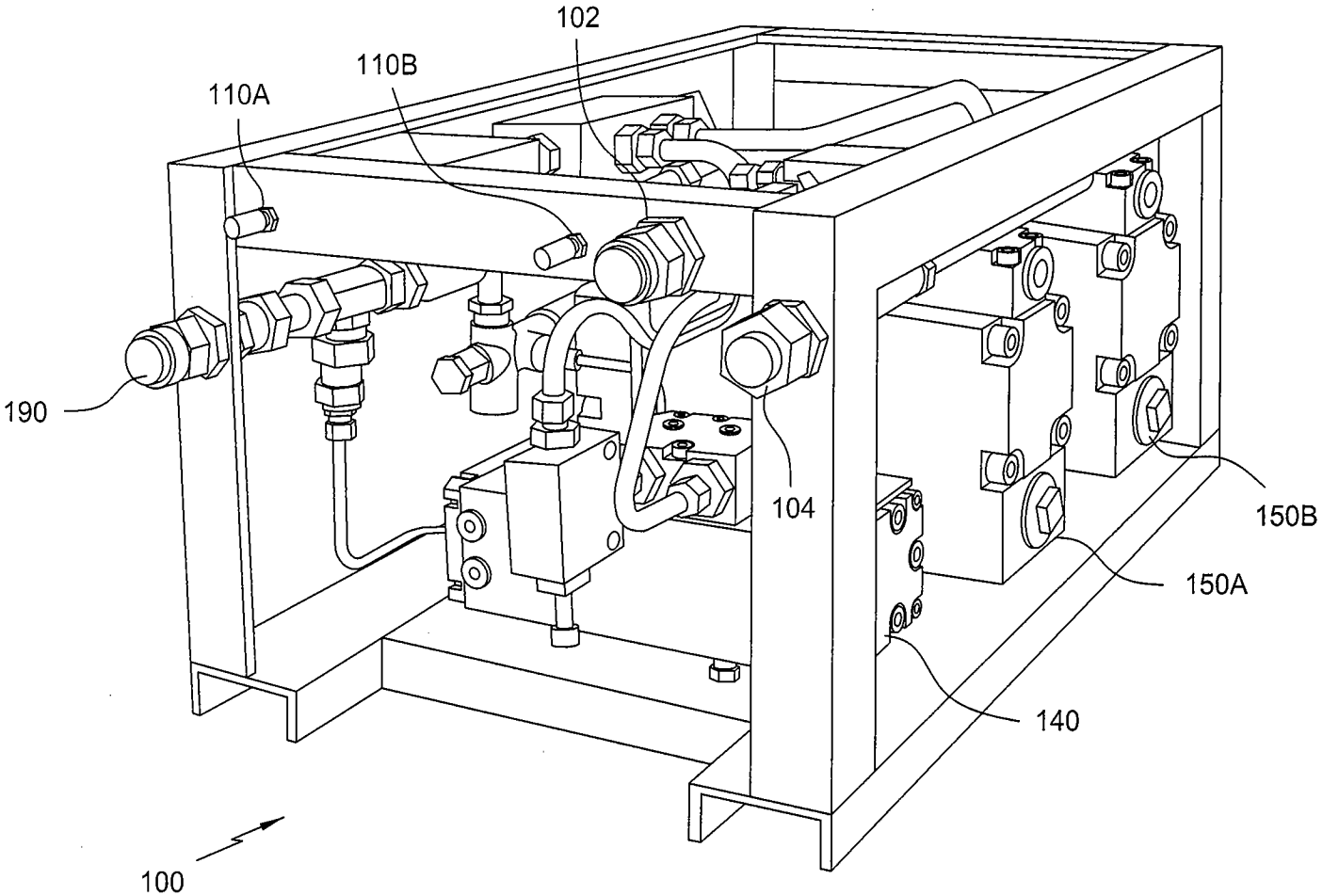
FIG. 1 is a perspective view of an embodiment of a tool used to close a blow out preventer ("BOP"), which shows various connections used to connect the tool to a remotely operated underwater vehicle ("ROV") and includes one high pressure pump and two high flow pumps.

FIG. 1 is a perspective view of an embodiment of the tool 100 used to close the BOP 300 (shown in FIG. 11), and shows various connectors used to connect the tool 100 to the ROV 200 (also shown in FIG. 11), as well as several components of the tool 100. This embodiment of the tool 100 includes one high pressure pump 140 and two high flow pumps 150A, B. The tool 100 receives hydraulic pressure from the ROV 200 via a line connected to a pressure connector 102, and the tool 100 relieves any excess pressure via an ROV line connected to a return connector 104. The ROV 200 is also connected to two pilot operated check valves 110A, B, which may allow the hydraulic pressure from the ROV to reach either the high pressure pump 140 or the two high flow pumps 150 A, B. The pumps 140, and 150A, B in turn, use the hydraulic pressure from the ROV 200 to pump a fluid 170 (shown in FIGS. 2 and 3) to the BOP 300. In the preferred embodiment, a first end of a hot stab is connected to a BOP connector 190 of the tool 100, and a second end of the hot stab is connected to the BOP 300.

Figure 2:
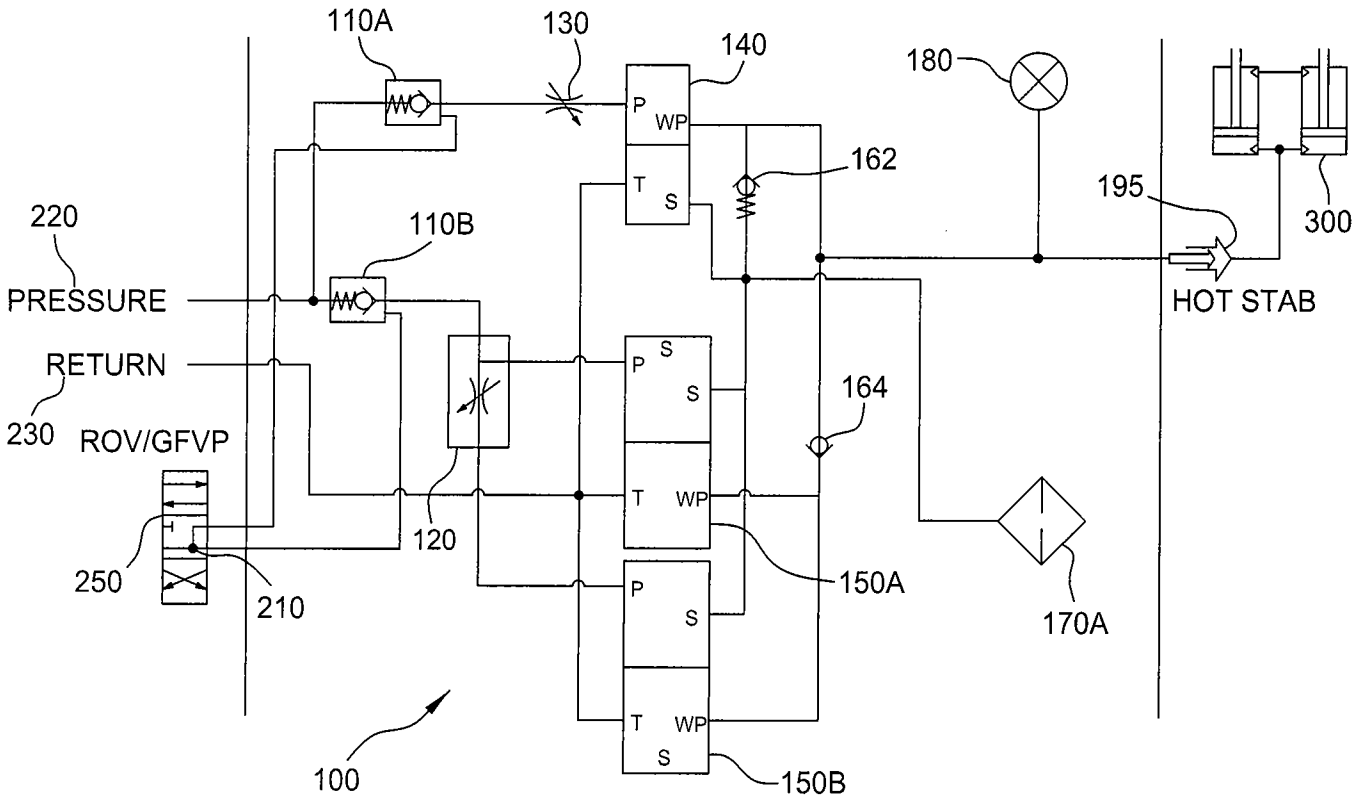
Figure 3:
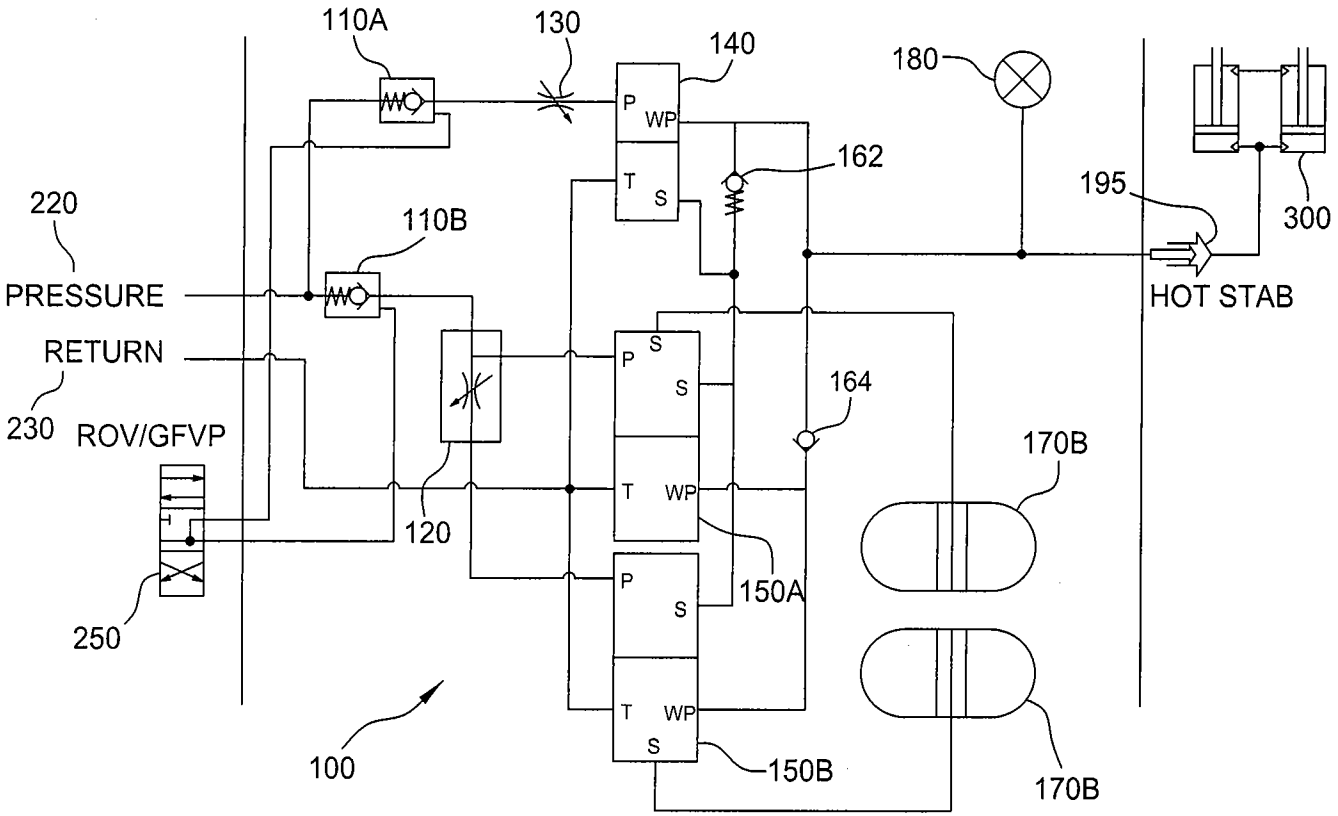

FIGS. 2 and 3 are detailed schematics of embodiments of the tool 100 shown in FIG. 1, wherein FIG. 2 illustrates the tool 100 when seawater 170A is the fluid pumped to the BOP 300, and wherein FIG. 3 illustrates the tool when a fluid 170 housed in one or more reservoirs, such as hydraulic fluid including glycol or oil 170B, is the fluid pumped to the BOP 300. The operation of the tool in FIGS. 2 and 3 are substantially similar except where noted. The tool 100 has a pressure connector 102 for connection with a pressure line 220 from the ROV 200 and a return connector 104 for connection with a return line 230 from the ROA 200. The tool 100 may also be connected to the ROV 200 using an ROV general function valve pack ("ROV GFVP") 250. The ROV GFVP 250 communicates with at least two pilot operated check valves 110A, B of the tool 100, and provides hydraulic power to one of the pilot operated check valves 110A, B at a given time.

When the tool 100 is initially used, the ROV GFVP 250 routes hydraulic power to the pilot operated check valve 110B located upstream of a flow priority valve 120 and to high flow pumps 150A, B. The hydraulic pressure opens the pilot operated check valve 110B and allows the hydraulic pressure to flow to the flow priority valve 120. Once hydraulic pressure upstream of the flow priority valve 120 reaches a minimum pressure set by the flow priority valve 120, the valve 120 opens and allows the hydraulic pressure to operate the high flow pumps 150A, B. In one embodiment, the flow priority valve 120 is a flow divider valve, and the flow priority valve 120 ensures that each high flow pump 150A, B receives enough fluid to maintain even running of both pumps 150A, B. An exemplary high flow pump 150 for use in the tool 100 of the present invention is a Dynaset HPW 90/150-85 pump.

The high flow pumps 150A, B use the hydraulic pressure to pump the fluid 170 out to the BOP 300, and in one embodiment, through a hot stab connection 195. A check valve 164 ensures the fluid 170 does not flow back to the high flow pumps 150A, B. A gauge 180 on the downstream side of the high flow pumps 150A, B, and upstream of the BOP output 190, allows pressure of the fluid 170 to be monitored. As the fluid 170 circulates through the high flow pumps 150A, B, and out to the BOP 300, flow rate and pressure of the fluid 170 increases.

Figure 4:
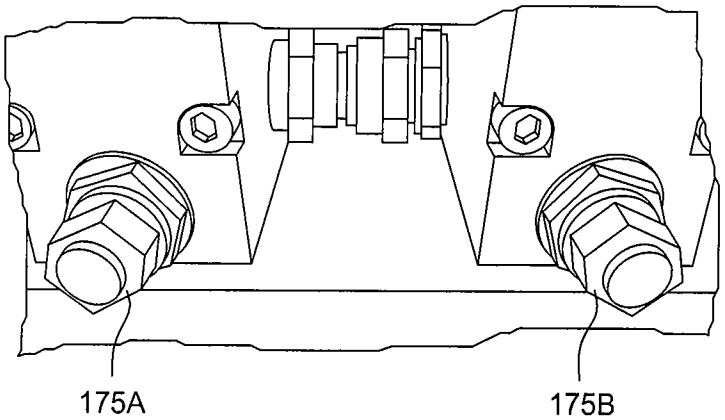
FIG. 4 illustrates two connections of the tool, which are used when fluid, other than seawater, is pumped by the tool.

The fluid 170 may be seawater 170A, glycol 170B, or any other oil or fluid appropriate for subsea operations. If the fluid 170 is glycol 170B or any other oil, such fluid 170B is stored in reservoirs near the tool 100. The fluid is then connected via appropriate hoses to fluid connectors 175 in the tool 100. Examples of these fluid connectors 175A, B, which are attached to the pumps 140, 150 of the tool 100, are shown in FIG. 4. If the tool 100 uses seawater 170A as the fluid 170, the same fluid connectors 175 (as shown in FIG. 4) are used to receive the seawater 170A, but a filter hose assembly 177, shown in FIGS. 5A and 5B, may be attached to the fluid connector 175. In one embodiment, the tool 100 may use both seawater 170A and glycol 170B (or any other oil or fluid appropriate for subsea operations). For example, the tool 100 may initially use glycol 170B. Once the glycol 170B is substantially depleted, a valve, which may be hydraulically operated, can be adjusted to allow the tool 100 to operate using seawater 170A.

Turning back to FIGS. 2 and 3, the hydraulic pressure of the ROV 200 (shown in FIG. 11) may be shifted away from the high flow pumps 150A, B to the high pressure pump 140 by opening the pilot operated check valve 110A that is located upstream from the high pressure pump 140. In one embodiment, the ROV GFVP 250 routes the hydraulic pressure from the pilot operated check valve 110B to the pilot operated check valve 110A. As a result, the check valve 110B closes, and the hydraulic pressure from the pressure line 220 may no longer circulate to and operate the high flow pumps 150A, B. After this shift, hydraulic pressure is only provided to the high pressure pump 140.

After pilot operated check valve 110A is opened, the hydraulic pressure from the ROV 220 flows through a flow control valve 130 to the high pressure pumps 140. An exemplary high pressure pump 140 for use in the tool 100 of the present invention is a Dynaset HPW 520/30-85 pump. The hydraulic pressure supplies the power to the high pressure pump 140 to pump the fluid 170 out to the BOP 300, preferably through a hot stab connection. A relief valve 162 is located downstream of the high pressure pump 140 to relieve fluid pressure from the system should the pressure exceed a specified pressure (preferably, the maximum pressure on the system is 5,000 psi). The check valve 164 prevents fluid 170 from flowing back to the high flow pumps 150A, B. When the tool 100 includes one Dynaset HPW 520/30-85 high pressure pump and two Dynaset HPW 90/50-85 high flow pumps, the tool 100 can increase the pressure of the fluid from approximately 3000 psi to 7000 psi, and can increase the flow rate of the fluid from approximately 100-150 L/min to 200-300 L/min.

Figure 5A:
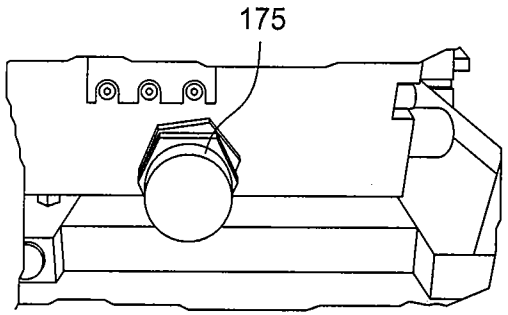
FIGS. 5A and 5B illustrate a connection of the tool and a filter needed when seawater is pumped by the tool.
Figure 5B:
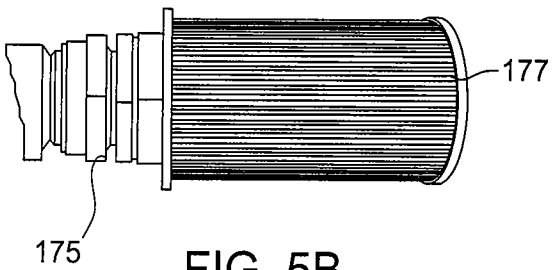
Figure 6:
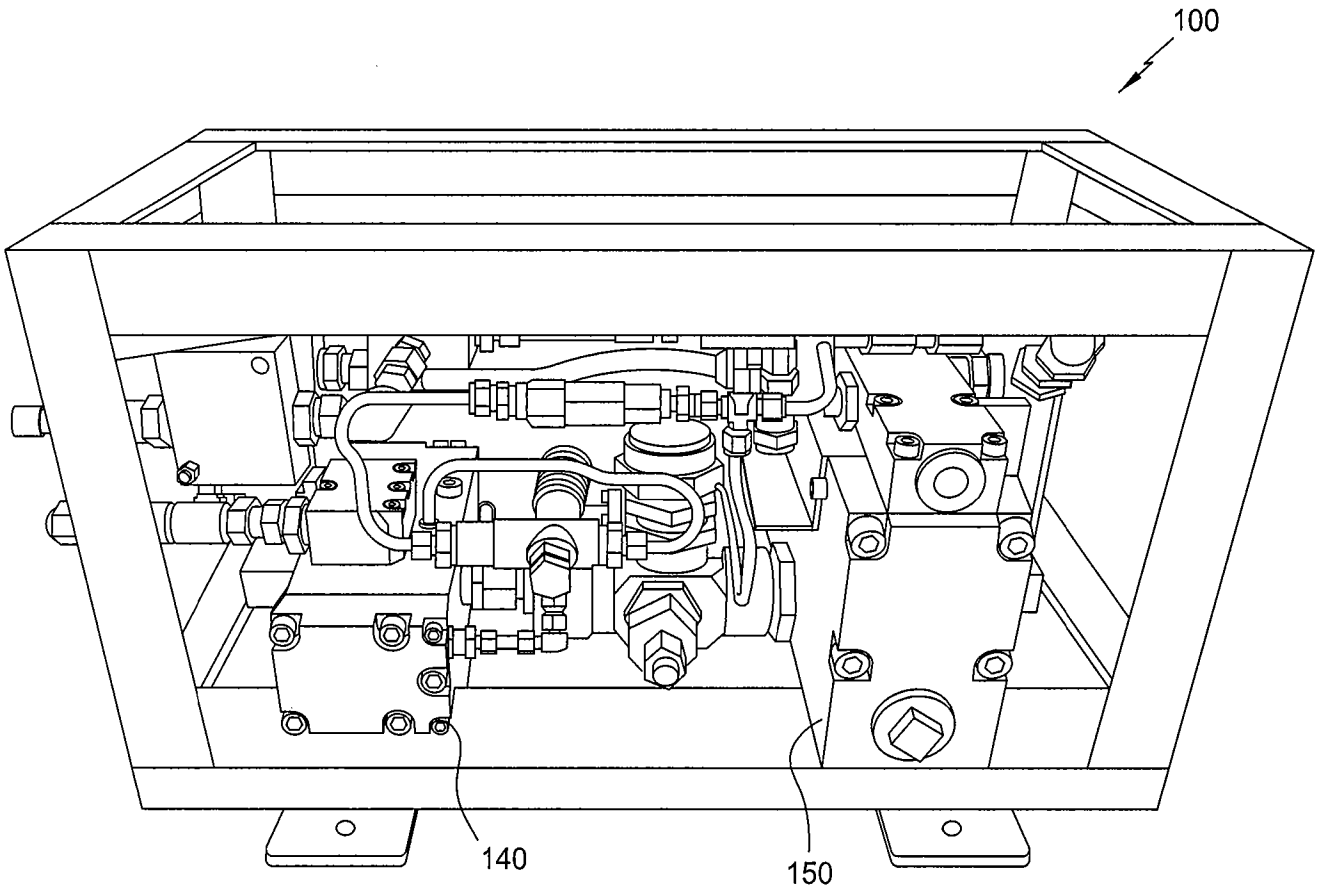
FIG. 6 is a perspective view of an embodiment of the tool, which includes one high pressure pump and one high flow pump.

FIG. 6 is a perspective view of yet another embodiment of the tool 100, which comprises one high pressure pump 140 and one high flow pump 150. This embodiment operates in substantially the same manner, and is configured substantially the same as the embodiment shown in FIGS. 1-5.

Figure 7:
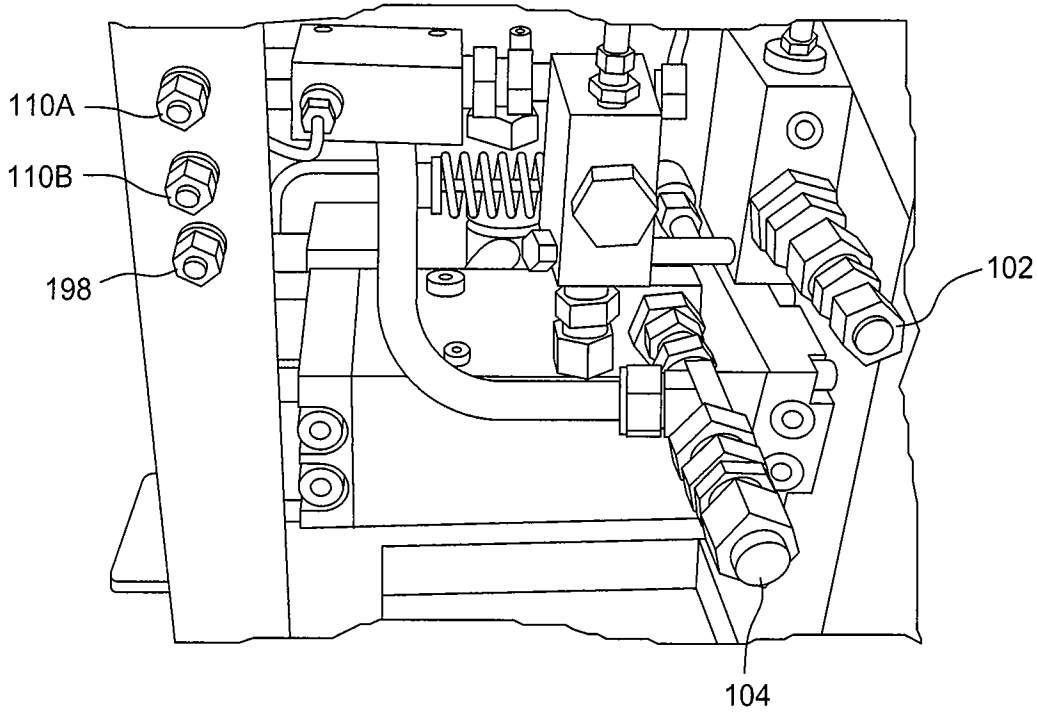
FIG. 7 is a perspective view of the embodiment of the tool shown in FIG. 6, which shows various connections used to connect the tool to the ROV.

FIG. 7 is another perspective view of the embodiment of the tool 100 shown in FIG. 6, which shows various connections used to connect the tool 100 to the ROV 200. The same hydraulic connections shown in FIG. 1 are shown in FIG. 7, with the addition of an optional depressurization valve 198. The depressurization valve 198 is used to bleed hydraulic pressure off of the tool 100 after the tool 100 has completely actuated the BOP 300. Furthermore, the depressurization valve 198 may be incorporated into the tool 100 shown in FIGS. 2 and 3, and used for the same purpose.

Figure 9:
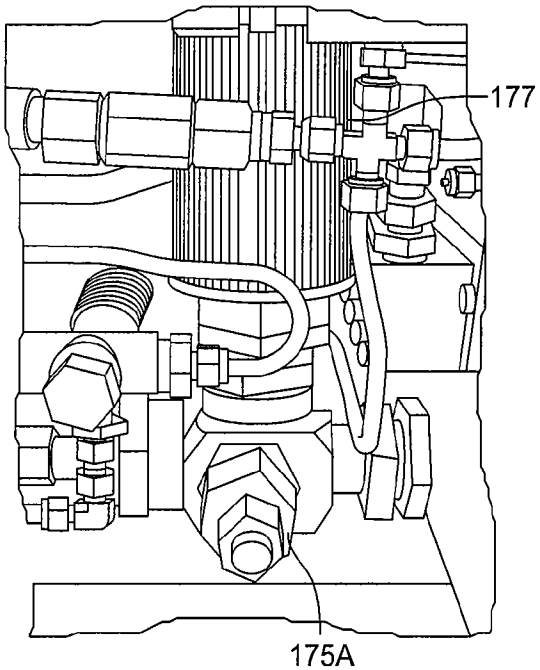
FIGS. 8 and 9 illustrate connections of the tool shown in FIGS. 6 and 7 to the fluid source: gloycol/oil and seawater, respectively.
Figure 8:
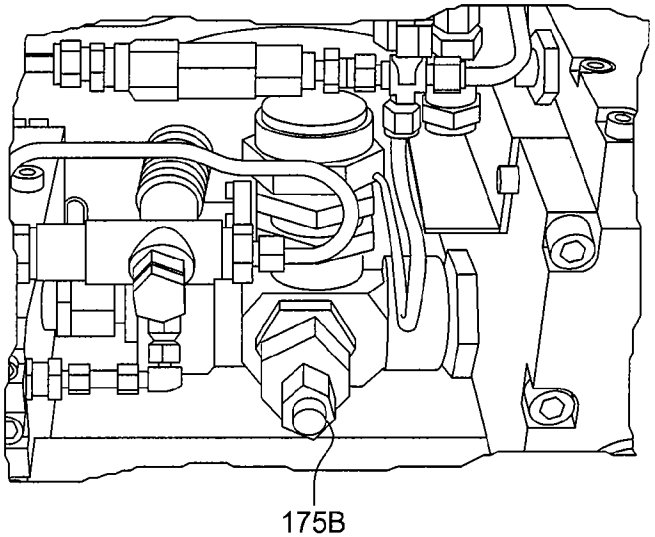

FIGS. 8 and 9 illustrate the fluid connections 175A, B of the tool 100 that receive the hoses that carry fluid 170. Similar to FIG. 4, FIG. 8 shows the basic fluid connector 175B that is used for glycol, oil, and other fluids 170B kept in a reservoir. Similar to FIGS. 5A and 5B, FIG. 9 shows the fluid connector 175A connected to the filter hose assembly 177 when seawater 170A is used in the tool 100. In one embodiment, the tool 100 may use both seawater 170A and glycol 170B (or any other oil or fluid appropriate for subsea operations). For example, the tool 100 may initially use glycol 170B. Once the glycol 170B is substantially depleted, a valve, which may be hydraulically operated, can be adjusted to allow the tool 100 to operate using seawater 170A.

Figure 10:
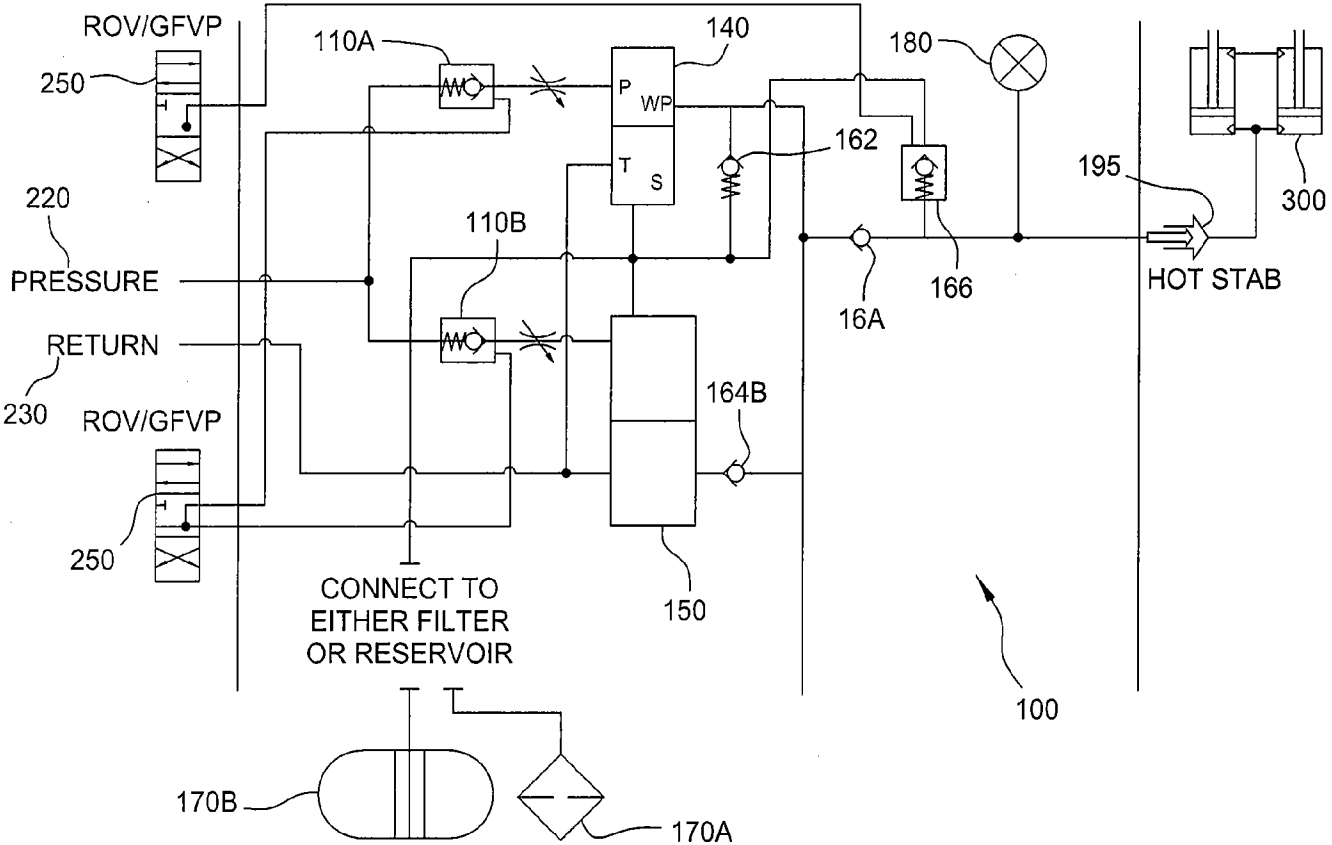
FIG. 10 is a schematic of the embodiment of the tool shown in FIGS. 6-9.

FIG. 10 is a schematic of the embodiment of the tool 100 shown in FIGS. 6-9. The embodiment of this tool is substantially similar to the embodiment of the tool 100 shown in FIGS. 1-5, except, as discussed, this embodiment of the tool 100 contains only one high pressure pump 140 and one high flow pump 150. In addition, a flow control valve is located downstream of each check valve 110A, B, and upstream of the high flow pump 150 and the high pressure pump 140. Also, instead of one check valve being used downstream of the high flow pump 150, several check valves 164A, B are placed downstream of the high flow pump 140. These valves 164A, B ensure fluid pressure is not removed from the system. In addition, a depressurization valve 166 is placed downstream of the pumps 140, 150, which allows the tool 100 to relieve all of the hydraulic pressure after the BOP 300 has been fully actuated. In one embodiment, the depressurization valve 166 may be manually operated. In one embodiment, the depressurization valve 166 may be remotely operated or operated by the ROV GFVP 250. The same ROV GFVP 250 used to operate the pilot check valves 110A, B may be used, or a different ROV GFVP 250 may be used to operate the depressurization valve 166. Otherwise, the tool 100 shown in FIGS. 1-5 operates substantially identical to the tool 100 shown in FIGS. 6-10. When the tool 100 is configured with one Dynaset HPW 520/30-85 high pressure pump and one Dynaset HPW 90/50-85 high flow pump, the tool 100 can increase the fluid pressure from approximately 3000 psi to 7000 psi, and can increase the flow rate from approximately 35-85 L/min to 70-150 L/min.

The tool 100 may be configured as a component that can be bolted onto the ROV 200 directly, along with reservoirs for holding fluid 170 if desired, or the tool 100 may be placed on a skid and used on or near the ROV 200, depending on the ROV configuration.

In one embodiment, the method of actuating a BOP 300 includes hydraulically connecting an upstream side of a tool 100, such as the tool 100 disclosed above, to an ROV 200, and connecting a downstream side of the tool 100 to the BOP 300. Initially, hydraulic power from the ROV 200 is used to operate one or more high flow pumps 150A, B contained within the tool 100, and after the pressure of the fluid 170 being pumped through the tool 100 to the BOP 300 reaches 1300-1500 psi, the hydraulic power is switched to operate the high pressure pump 140 within the tool 100. In the preferred method of the invention, if the pressure of the fluid 170 drops below 1300 psi during operation of the high pressure pump 140, the hydraulic power is switched back to operate one or more high flow pumps 150A, B within the tool 100. After the BOP 300 is fully actuated, the tool 100 is disconnected from the BOP 300, and then depressurized by activating a depressurization valve 198 and allowing the pressure to bleed off, for example, to atmosphere.

Figure 11:
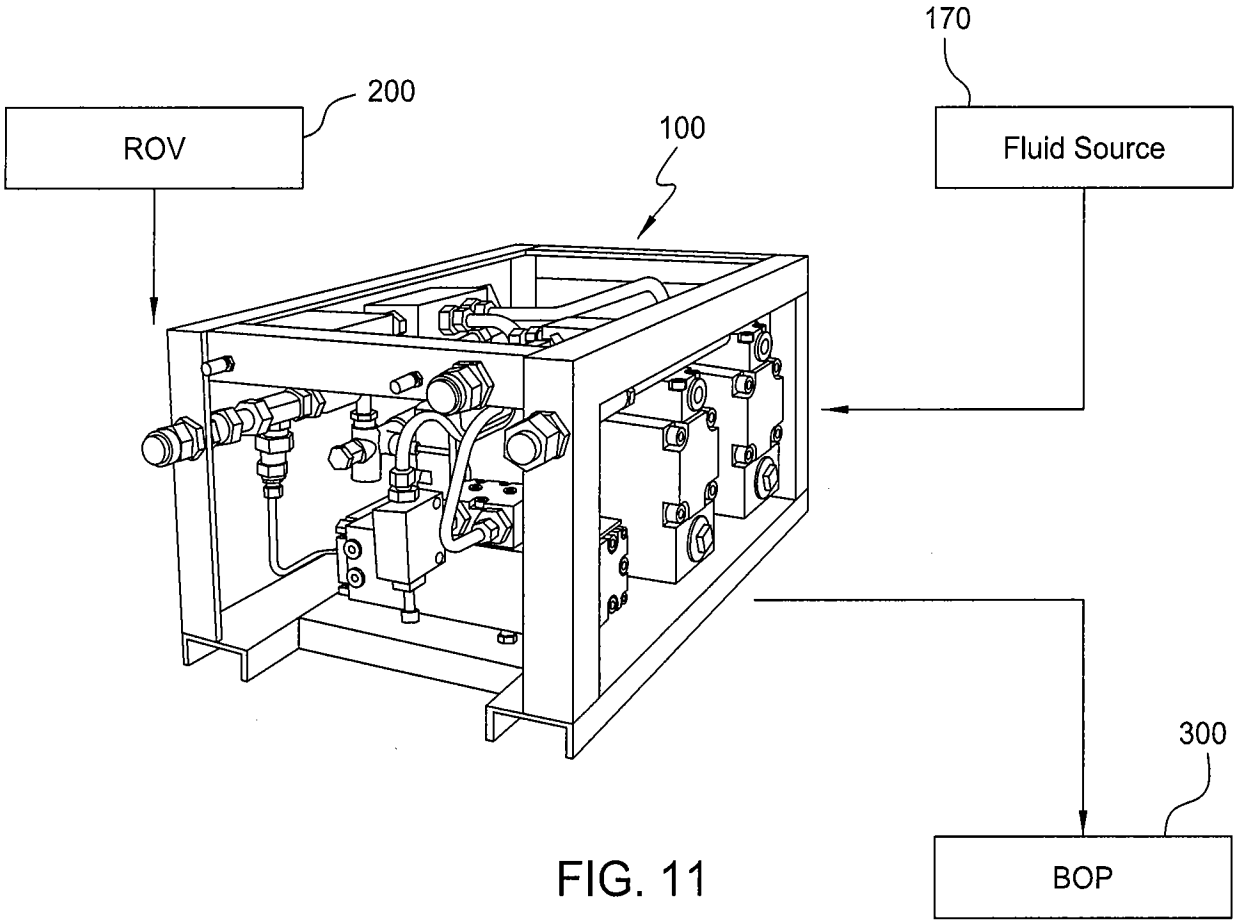
FIG. 11 is flow diagram showing a system for closing a BOP.

FIG. 11 is flow diagram showing an embodiment of a system for closing the BOP 300. In the system, the ROV 200 supplies hydraulic power to the tool 100, and the tool pumps fluid 170 from an external source out to the BOP 300. The tool 100 uses a high pressure pump 140 and one or more high flow pumps 150, which in turn increases the pressure and flow rate of the fluid 170 being pumped to the BOP 300. Because the fluid 170 is pumped to the BOP 300 at a high pressure and flow rate, the BOP is able to be fully actuated at a rapid speed.

While the foregoing is directed to embodiments of the invention, other and further embodiments of the invention may be devised without departing from the basic scope thereof, and the scope thereof is determined by the claims that follow.

The invention claimed is:

1. A tool for actuating a blow out preventer ("BOP"), the tool comprising:

one or more connections configured to receive fluid power from a remotely operated vehicle ("ROV");

a fluid powered high pressure pump fluidly connected to the one or more connections and configured to increase pressure of an operating fluid for the BOP;

a fluid powered high flow pump fluidly connected to the one or more connections and configured to increase flow rate of the operating fluid, wherein the high flow pump is configured to pump the operating fluid to the BOP until a predetermined pressure is reached, wherein once the predetermined pressure is reached, the fluid power is shifted from the high flow pump to the high pressure pump via the one or more connections; and a conductor configured to transport the operating fluid to the BOP.

2. The tool of claim 1, wherein the fluid power is hydraulic power used to operate high pressure and high flow pumps.

3. The tool of claim 2, wherein the hydraulic power is shifted to alternately operate the high pressure and high flow pumps.

4. The tool of claim 1, wherein the tool comprises at least two fluid powered high flow pumps.

5. The tool of claim 1, wherein once pressure falls below the predetermined pressure, the fluid power is shifted from the high pressure pump to the high flow pump.

6. The tool of claim 1, wherein the tool further comprises a valve fluidly connected to the one or more connections and configured to direct the fluid power from the ROV to at least one of the high pressure pump and the high flow pump.

7. The tool of claim 1, wherein the operating fluid is seawater.

8. The tool of claim 1, wherein the operating fluid is hydraulic fluid.

9. A method for actuating a blow out preventer ("BOP"), comprising:

fluidly connecting a remotely operated vehicle ("ROV") to a tool, wherein the tool includes a high flow pump and a high pressure pump;

fluidly connecting the tool to the BOP;

powering the high flow pump to increase a flow rate of an operating fluid pumped by the high flow pump to the BOP until a predetermined pressure of the operating fluid is reached;

once the predetermined pressure of the operating fluid is reached, shifting power from powering the high flow pump to powering the high pressure pump to further increase the pressure of the operating fluid; and conducting the operating fluid from the tool to the BOP to actuate the BOP.

10. The method of claim 9, wherein the ROV supplies hydraulic power to one or more high flow pumps of the tool until the operating fluid reaches the predetermined pressure.

11. The method of claim 10, further comprising shifting the hydraulic power from the one or more high flow pumps to the high pressure pump after the operating fluid reaches the predetermined pressure.

12. The method of claim 9, further comprising shifting power from the high pressure pump to the high flow pump if pressure of the operating fluid drops below the predetermined pressure.

13. The method of claim 9, further comprising disconnecting the tool from the BOP after the BOP is fully actuated.

14. The method of claim 13, further comprising depressurizing the tool after the tool is disconnected from the BOP.

15. The method of claim 9, further comprising filtering the operating fluid.

16. A system for actuating a blow out preventer ("BOP"), comprising:

a remotely operated underwater vehicle ("ROV"), and a tool fluidly connected to the ROV, wherein the ROV is configured to power one or more pumps of the tool to increase pressure and flow rate of fluid from a fluid source to the BOP until the BOP is fully actuated, and wherein the tool is movable between a first position in which the tool is connected to the BOP and a second position in which the tool is disconnected from the BOP.

17. The system of claim 16, wherein the one or more pumps include at least one high pressure pump configured to increase pressure of the fluid from the fluid source and at least one high flow pump configured to increase flow rate of the fluid from the fluid source.

18. The system of claim 17, wherein a valve directs the power to either the at least one high pressure pump or the at least one high flow pump.

19. A method for actuating a blow out preventer ("BOP"), comprising:

connecting an actuation tool to the BOP;

supplying power from a remotely operated underwater vehicle ("ROV") to the actuation tool;

increasing a pressure and a flow rate of an actuation fluid pumped by the actuation tool;

supplying the actuation fluid from the actuation tool to the BOP to actuate the BOP; and disconnecting the actuation tool from the BOP once the BOP is fully actuated.

20. The method of claim 19, wherein the ROV hydraulically powers the actuation tool.

* * * * *